US006085476A

United States Patent [19]

Jantzi et al.

[11] Patent Number: 6,085,476

[45] Date of Patent: Jul. 11, 2000

[54] TRANSPORTABLE BUILDING FORM

[76] Inventors: David B. Jantzi, 5480 Elm St.; Thomas B. Roe, IV, 7693 State St., both of Lowville, N.Y. 13367

[21] Appl. No.: 08/940,451

[22] Filed: Sep. 30, 1997

[51] Int. Cl.[7] ..... E04B 2/40

[52] U.S. Cl. ..... 52/223.7; 52/262; 52/265; 52/274; 52/293.3; 52/309.15; 52/439

[58] Field of Search ..... 52/439, 223.7, 52/745.1, 747.1, 265, 275, 293.3, 262, 426, 427, 309.15; 249/27, 194

[56] References Cited

U.S. PATENT DOCUMENTS

| | | | |
|---|---|---|---|
| 340,070 | 4/1886 | Carrico | 249/27 |
| 1,579,822 | 4/1926 | Knickerbocker | 249/27 |
| 1,694,037 | 12/1928 | Kuert | 249/27 |
| 2,102,447 | 12/1937 | Whitacre | 52/223.7 |
| 2,518,186 | 8/1950 | Rumble | 249/27 |
| 3,182,374 | 5/1965 | Cook | 249/27 |
| 3,255,562 | 6/1966 | Altschuler . | |
| 3,378,969 | 4/1968 | Larger | 52/223.7 |
| 3,410,044 | 11/1968 | Moog . | |
| 4,093,173 | 6/1978 | Kawamata et al. | 249/27 |
| 4,416,097 | 11/1983 | Weir . | |
| 4,757,656 | 7/1988 | Powers, Jr. | 52/223.7 |
| 5,323,578 | 6/1994 | Chagnon et al. . | |
| 5,367,845 | 11/1994 | Hartling . | |
| 5,371,990 | 12/1994 | Uddin . | |

*Primary Examiner*—Michael Safavi
*Attorney, Agent, or Firm*—Wall Marjama Bilinski & Burr

[57] ABSTRACT

A transportable form structure for use in making a building. In accordance with the invention modular interlocking form blocks are stacked on a base frame and then secured so that the blocks do not become dislodged when encountering stresses during transport. Preferably the blocks are securing by applying a vertically directed compression force to the walls of the structure about the periphery thereof. When the form structure is completed, it is both strong and light weight. It can be lifted onto a vehicle and transported to a location of installation. At an installation location, the form structure is secured to a foundation, and filled with a filler material such as concrete.

30 Claims, 5 Drawing Sheets

10
14
12
32
34

24
40
28

26
22
14
18
38
16
20
12

30
28
36
26

FIG.5
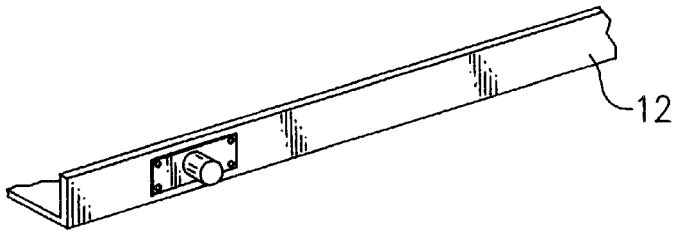
FIG.5A
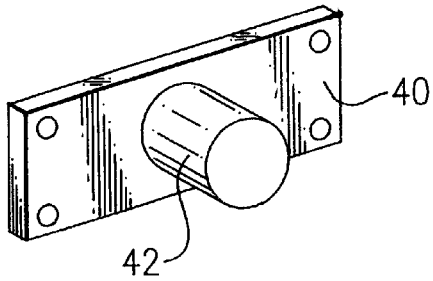
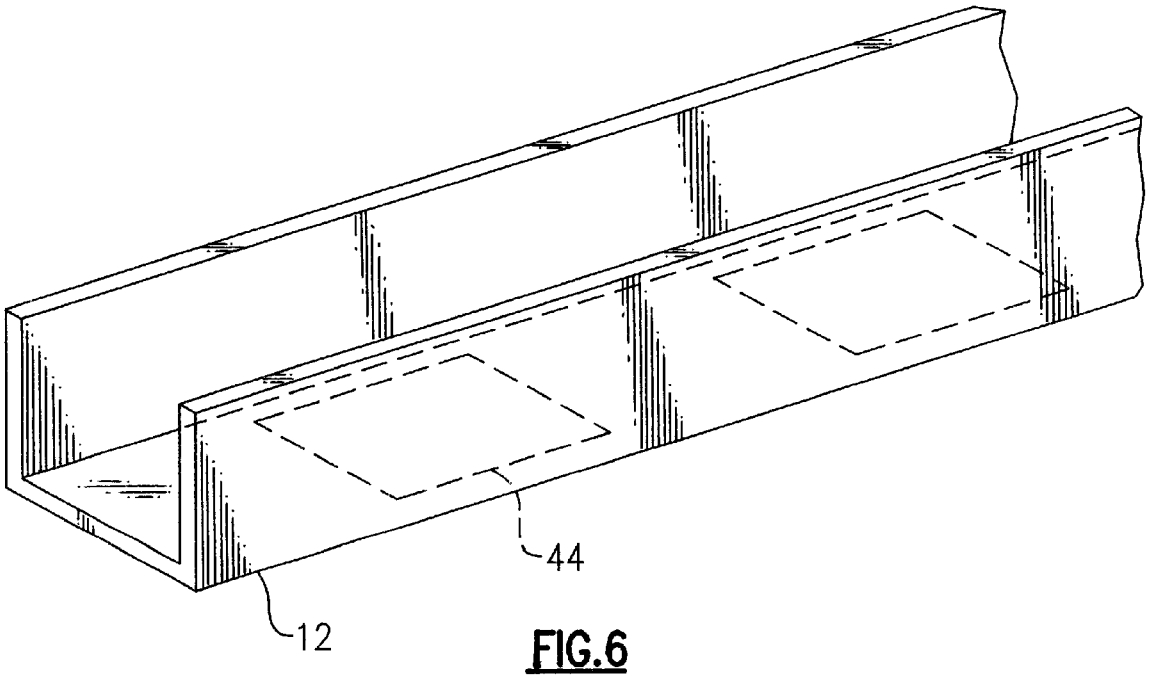
FIG.6

TRANSPORTABLE BUILDING FORM

BACKGROUND OF THE INVENTION

1. Field of the Invention

The invention relates generally to modular structures, and in particular to a transportable modular form for use in the making of a building, especially of the type comprising concrete or other heavy material.

2. Background of the Prior Art

Existing buildings of the type comprising concrete or other heavy and structurally strong material require for construction a high intensity of effort at the location of installation. The process of laying concrete cinder blocks, or bricks in the making of a building, as is well known, is a costly and time consuming one, and one that requires highly skilled and experienced labor to carry out efficiently.

In recent years, the process of making buildings of the type comprising concrete or other heavy material has improved considerably. U.S. Pat. No. 4,706,429 for example, and related patents such as U.S. Pat. Nos. 3,552,076 and 3,410,044 describe methods for the making of buildings, wherein interlocking modular form blocks are stacked upon one another in the making of a form shaped according to the shape desired of the finished building. Concrete is then poured into the form, and after certain finishing steps are taken, a finished building is produced. A problem with these improved methods is that the methods still require a substantial amount of effort at the location of installation, especially in the stacking of the form blocks. Highly skilled workers have to travel to the location of installation to assemble the form blocks, and construction delays can result from inclement weather. Methods of the type described cannot be used in certain applications (such as military applications) requiring very high speed installation.

SUMMARY OF THE INVENTION

According to its major aspects and broadly stated, the invention is a transportable building shell for use in making a building. While the invention may be used to make buildings comprising virtually any material, the apparatus and method are especially well adapted for making buildings comprising concrete or similar filler material.

In the present invention, a transportable building shell structure is assembled at a first, location assembly, transported to a second, installation location, installed on a foundation, and filled with a filler material. By completing most of the assembly at a location away from the location of installation the assembly time and labor expenditures required at the location of installation are substantially reduced.

In the making of the building form, a base member is provided, and interlocking building form blocks are stacked on the base member in the fashion that such blocks are normally stacked together on a foundation at the location of installation. Blocks of the type which may be used are well known and typically comprise two opposing flat members that are held in uniform spaced relation to one another by spacers, which in addition to spacing the members provide reinforcement to the poured material eventually poured into the form. When a plurality of form blocks are stacked in layers, a wall is defined having two opposing wall members and a wall interior defined therebetween.

When the form blocks have been stacked in a configuration according to the desired shape of a finished building, a step should be taken to assure that the blocks do not become disconnected during transport of the hollow form. In the prior art, modular form blocks of the type used are held together by the force of friction alone. The form structure according to the invention preferably includes an apparatus or other means for increasing the holding force between at least two blocks beyond the friction force holding together the blocks. The blocks can be adhered to one another as they are stacked with a conventional adhesive by applying adhesive material between adjoining blocks during stacking. Preferably, however, the blocks are held together by applying a vertically directed compression force to each wall of the form.

In one embodiment of the invention, a compression force is applied by disposing at various points in a form structure's wall interior a plurality of tensioning members. Each tensioning member is rigidly secured to the bottom frame member and extends upwardly through a wall interior. At the top of the wall, the tensioning member is received by a bracket. The tensioning member is biased against the bracket so that the tensioning member applies a vertical compression force to the wall. The brackets are spaced apart so that openings are exposed at the top of the walls to allow disposal of filler material into the finished form structure. Roofing rafters may optionally be attached to the form structure.

When the step has been made to hold the form blocks together the form structure is in condition to be transported. The form structure is especially well suited for transport because of its light weight. Typically, the form structure is lifted by conventional means onto the flatbed of a truck and the carried to the location of installation.

At the location of installation the form structure is carried off the transport means and may be installed on a preestablished foundation or other flat surface. Typically the base frame of the form structure includes adaptations which facilitate the anchoring of the form structure onto a foundation.

When the form structure is positioned on a foundation, filler material is disposed therein. The most common type of filler material is concrete. However, other types of filler material such as sand, pebbles, or other non state-changing particulated filler material may be filled into the form. The form structure may be adapted so that filler material can be removed from the form once it has been applied if the filler material to be applied to the form is of a type which does not change state once it has been poured.

Conventional steps attendant to the completion of the building such as roofing steps or electrical wiring steps are then taken to complete construction of the building.

These and other features and advantages of the present invention will become clear to those persons skilled in the art of the invention from a reading of the Detailed Description of the Preferred Embodiments in connection with the referenced drawings.

BRIEF DESCRIPTION OF THE DRAWINGS

In the Drawings, wherein like numeral are used to indicate similar elements throughout the views.

FIG. 5 is a fragmentary perspective view of a form structure according to the invention showing a possible adaptation aiding in the transportability of the form structure;

FIG. 5A is an enlarged view of a peg shown in FIG. 5;

FIG. 6 is a fragmentary perspective view of a form structure according to the invention showing a possible adaptation for aiding in the removal of a filler material from the form structure.

DETAILED DESCRIPTION OF THE PREFERRED EMBODIMENTS

Figures 1A, 1B, 1C:
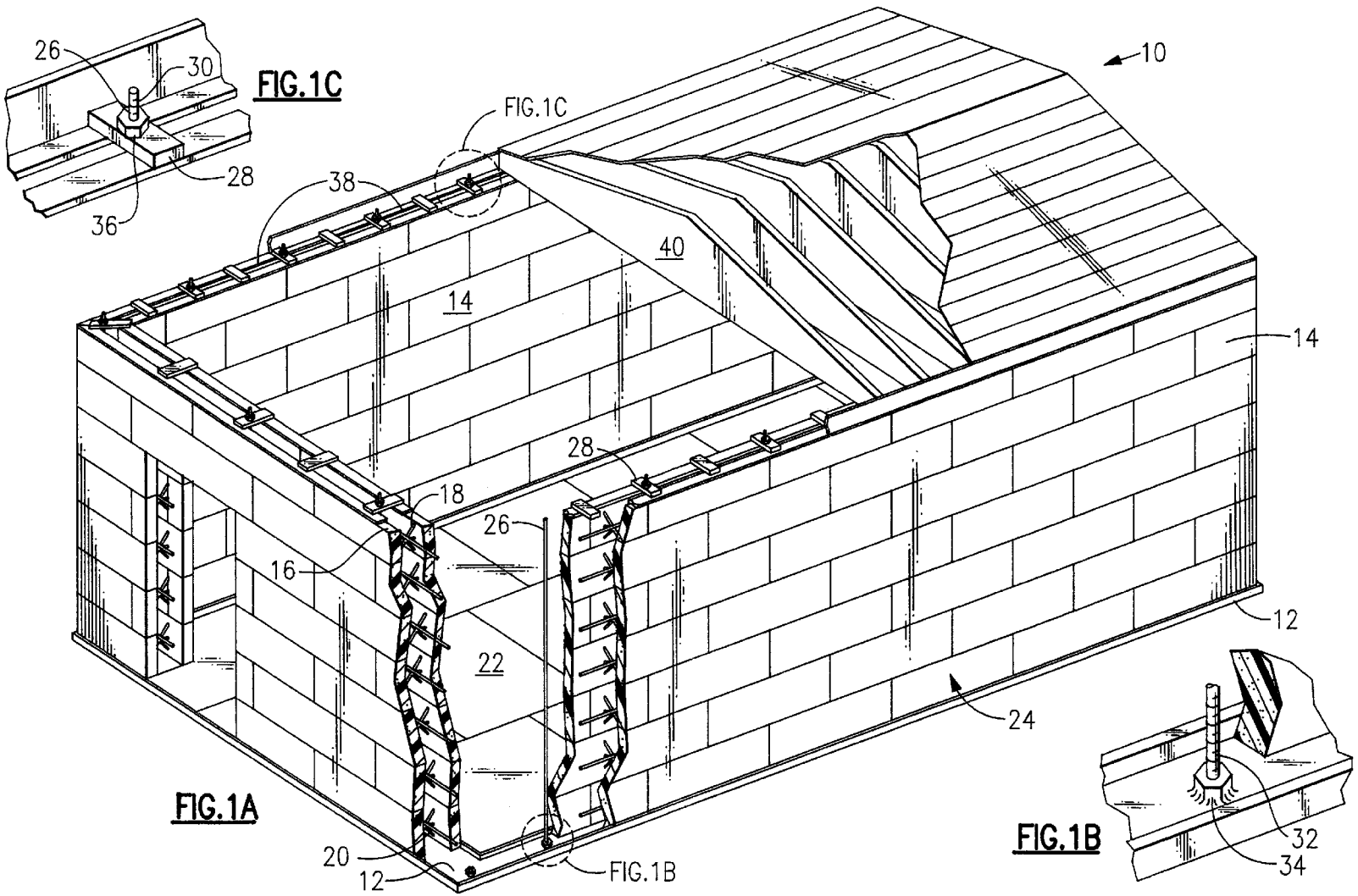
FIG. 1A is a perspective view of a transportable building form structure in accordance with the invention.
FIG. 1B is an exploded perspective view of a bottom end of a form structure wall according to the invention.
FIG. 1C is an exploded perspective view of a top end of a form structure wall.

The invention is described mainly with reference to FIGS. 1A–1C showing a building form structure 10 in accordance with the invention. According to a method of the invention, the building form structure shown is typically constructed at a first location assembly, transported to a second installation location, installed on a foundation, and filled with a filler material such as concrete. By completing the major share of the assembly at a location away from location of installation the assembly time and labor expenditures required at the location of installation are substantially reduced.

Describing the steps involved in making building form structure 10, a base member 12 is provided, and interlocking building form blocks 14 are stacked on the base member 12 in the fashion that such blocks are normally stacked together on a building foundation at the location of installation. Blocks of the type which may be used are well known and typically comprise two opposing substantially flat wall members 16 and 18 that are held in substantially uniform spaced relation to one another by spacers 20, which in addition to spacing the members 16 and 18 provide reinforcement to the poured material eventually poured into the form. Form blocks may be, for example, BLUE MAX form blocks of the type available from AAB Building Systems of Cobourg, Ontario or FORMULA BOARD form blocks of the type available from UC Industries of Parsippany, N.J. Blocks of the type used typically comprise lightweight and semirigid material such as expanded polystyrene, polyisocyanurate or other extruded plastic materials.

Base member 12 may optionally have integrated therein a floor 22 as shown in FIG. 1 or else base member 12 can be made without floor 22 if structure is intended to be mounted on a foundation having a floor integrated therein, for example, in the case where the form structure is intended to be installed on a foundation comprising a concrete slab.

When form blocks 14 have been stacked in a configuration according to the desired shape of a finished building, a step should be taken to assure that blocks 14 do not become disconnected during transport of the hollow form. In the prior art, modular form blocks of the type used are held together by the force of friction alone. Blocks held together by friction alone are susceptible to being disconnected when encountering stresses, such as those encountered by a form structure of the present invention during transport. Accordingly, a form structure of the present invention preferably contains a securing apparatus or material for increasing the holding force between at least two interconnected blocks beyond that supplied by the friction holding force between the blocks.

In one example of the invention, modular form blocks can be adhered to one another with a conventional adhesive while they are being stacked. Types of adhesives which may be used to hold form blocks 14 together may be, for example, polystyrene form adhesive. In this embodiment, an effective amount of adhesive material is disposed between adjoining modular blocks while the blocks are being stacked.

Blocks 14 can also be held together using, for example, high-strength tape or stressed skin interior and exterior panels.

Preferably, however, the blocks are held together by applying a vertically directed compression force to the walls 24 of the form at various points about the periphery of the form structure. The blocks can also be held together with a horizontally directed compression force or by a combination of compression forces applied in various directions.

In one embodiment of the invention, a compression force is applied by disposing at various points in a form structure's interior wall a plurality of tensioning members 26. Each tensioning member 26 is rigidly secured to base member 12 and extends upwardly through a wall of the form. At the top of wall 24, the tensioning member 26 is received by a bracket 28. Tensioning member 26 is biased against bracket 28 so that the tensioning member applies a vertically directed compression force at a specific portion of the structure's wall.

In the embodiment shown, the tensioning member is a bar having threads 30 formed on either end thereof. Bottom threaded end 32 may be received in bottom nut 34 formed at base member 12 while a conventional nut 36 may be threaded onto top threads 30 for biasing tensioning member 26 against bracket 28. It is seen that a vertically applied compression force is supplied to wall 24 at a specific wall portion by tightening nut 36 onto top threads 30.

Brackets 28 are spaced apart so that openings 38 are exposed at the top of the walls to allow disposed of filler material into the finished form structure. Roof rafters 40 may optionally be attached to the form structure.

Figure 2:
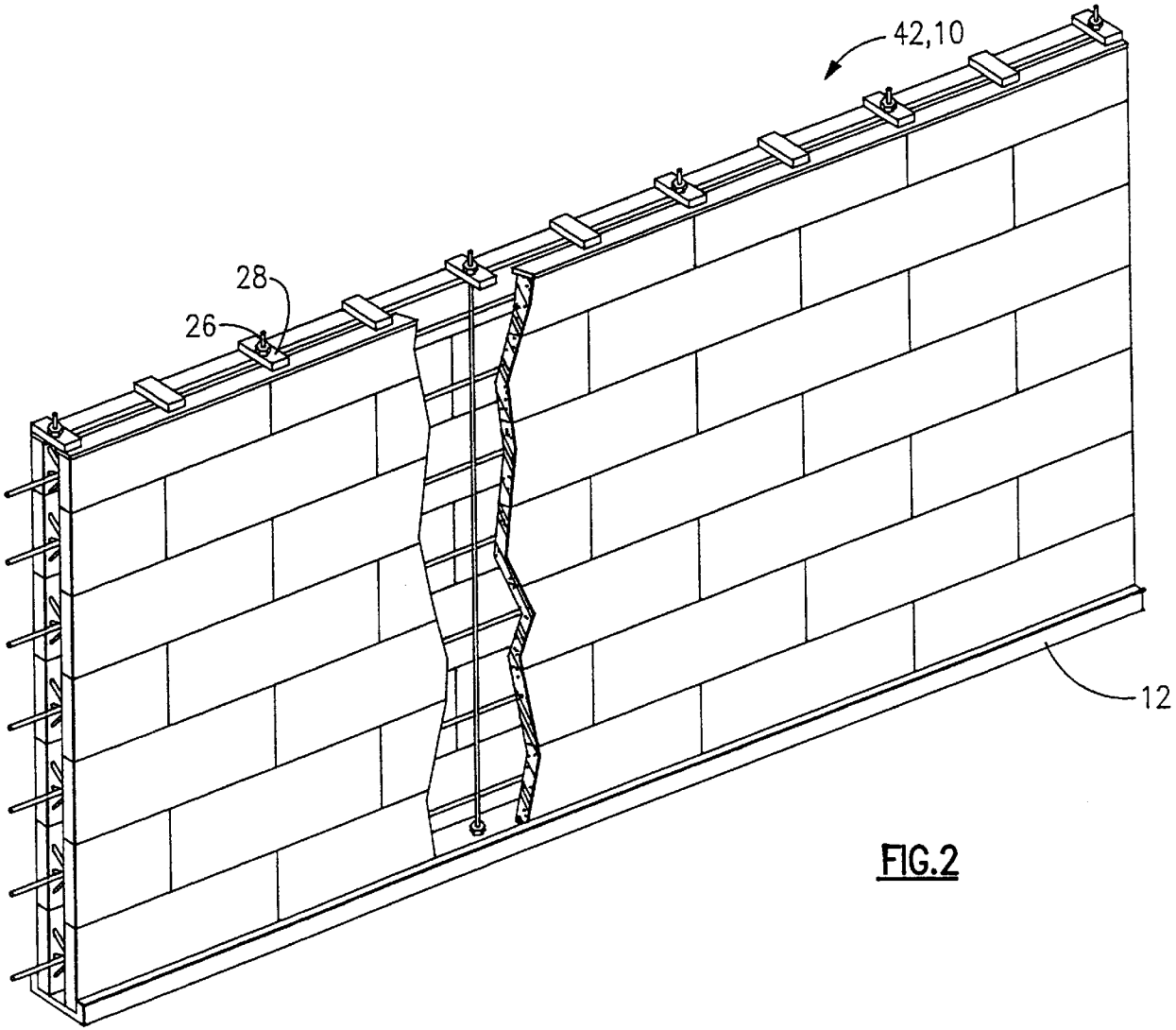
FIG. 2 is a simplified form structure according to the invention, wherein the form structure defines a single wall.
Figure 3:
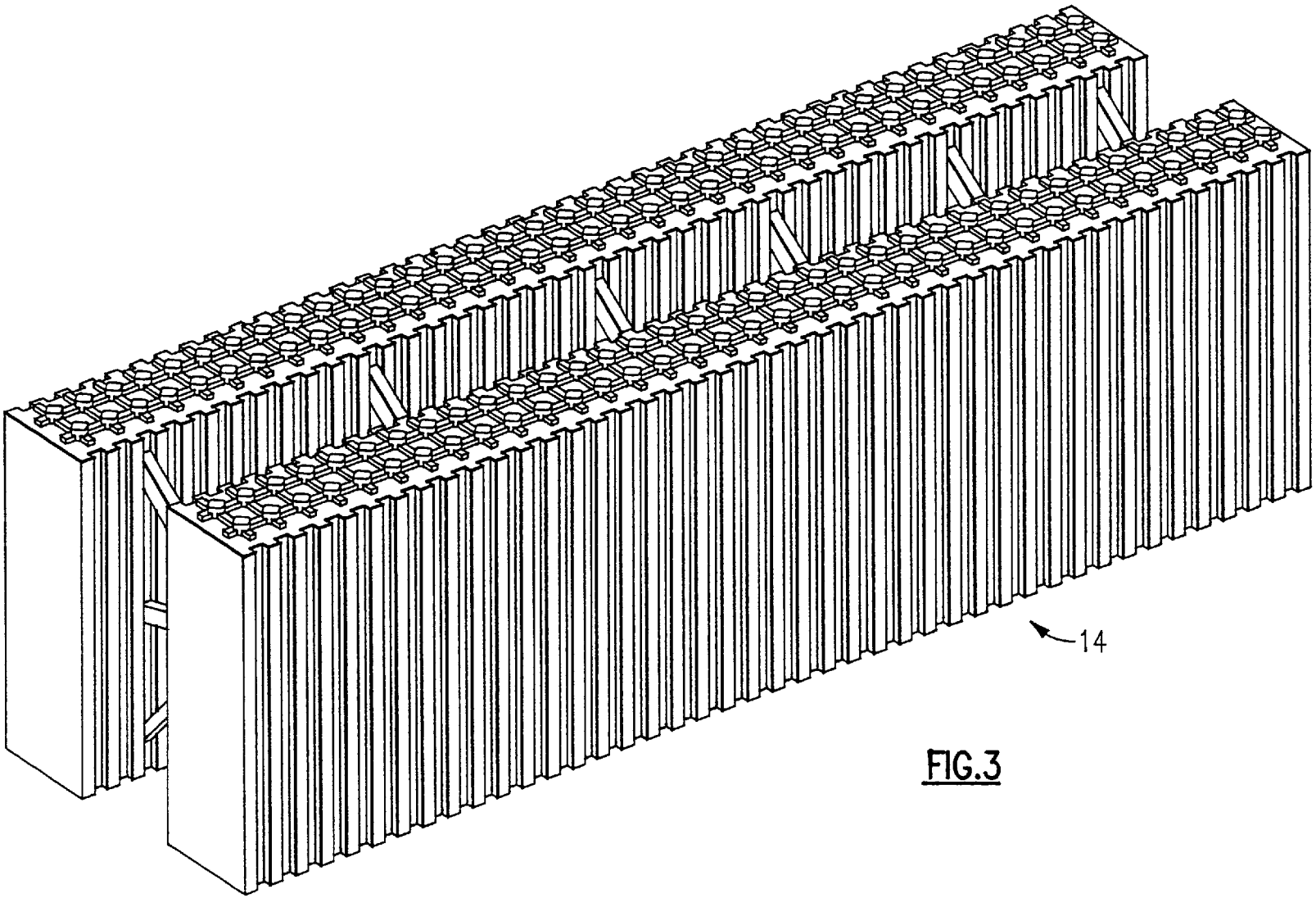
FIG. 3 is a perspective view of a modular form block of a type which may be used in making the invention.
Figure 4:
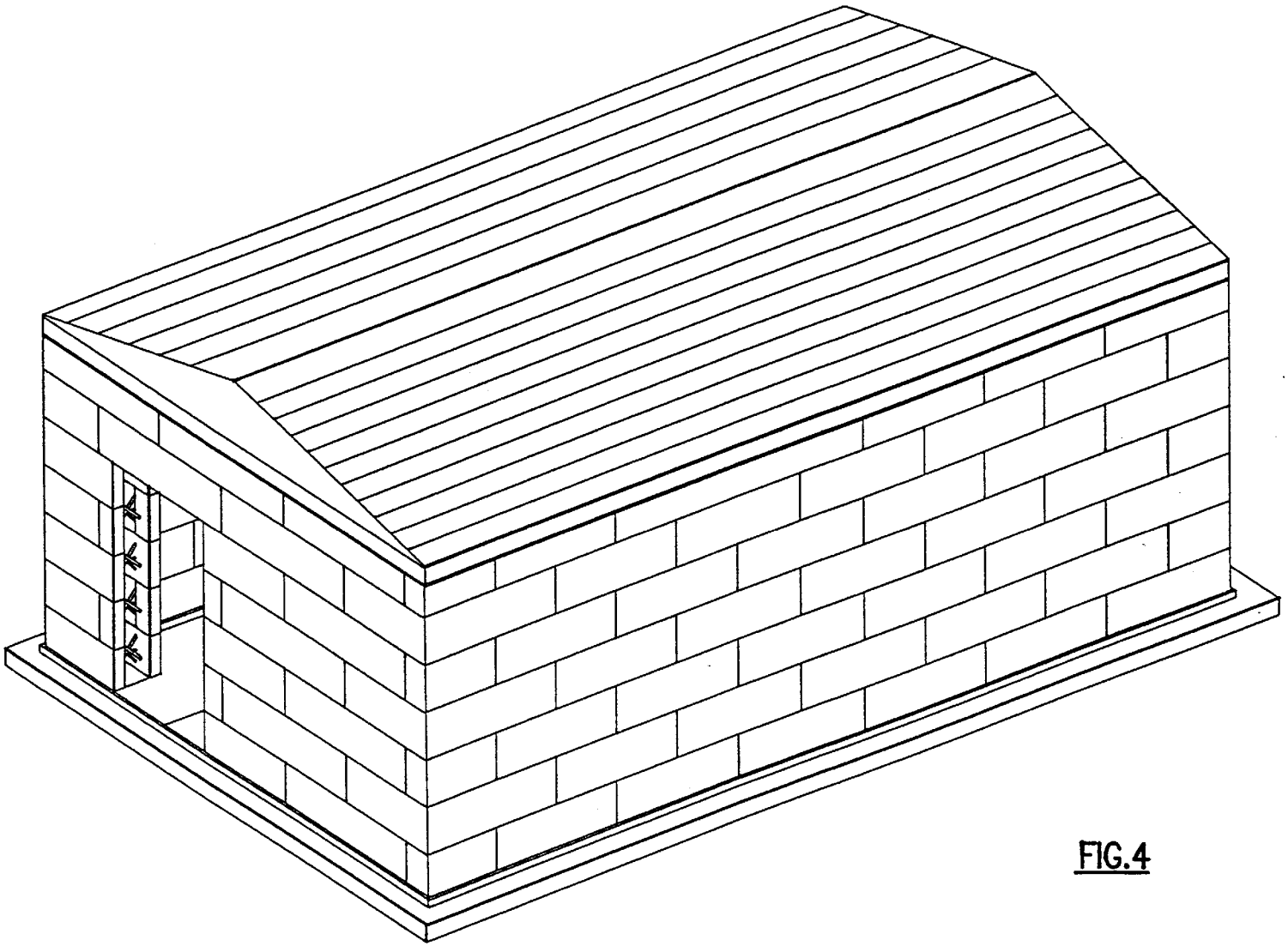
FIG. 4 shows a perspective view of a foundation on which a form structure may be installed.

A simplified version of the invention thusfar described is shown in FIG. 2. In a basic embodiment, the building form structure of the invention is a single wall 42, which may be assembled at an assembly location and installed at an installation location as a free standing wall, or incorporated into part of a building. Wall 42 may be supplied with a vertically applied compression force with use of at least one tensioning member 26 arranged as described with reference to Fig. 1A–1C.

When the step has been made to hold form blocks 14 together the form structure is in condition to be transported. The form structure is especially well suited for transport because of its light weight. Typically, the form structure is lifted onto the flatbed of a truck by well known lifting means such as with a fork lift or crane and then transported to the location of installation. Form structure 10 may include adaptations for aiding in the transportability thereof. For example, as shown in FIGS. 5*a* and 5*b* a bracket 40 having a peg 42 onto which a hook may be connected may be mounted to base member 12.

At the location of installation the form structure is moved by well known (e.g fork lift) means off the transport means and may be installed on a preestablished foundation 52 which may comprise grade beam, piers, a full foundation, or a foundation slab of hard, flat material such as concrete. The base frame of the form structure is typically welded or bolted onto the foundation.

When the form structure is situated on foundation 52, filler material is disposed therein. The most common type of filler material is concrete. However, other types of filler material such as sand, pebbles, or other non state-changing particulated filler material may be filled into the form. If the filler material which is poured into form structure is of the type which is poured in a liquid state and hardens to a solid state, it can be seen that tensioning member 26 provides the dual functions of securing the modular blocks comprising the form, and of reinforcing the filler material which is poured into the structure and then hardens. The filler material may also comprise a lightweight material. For example, the filler material may comprise cellulose, fiberglass, or other insulation material.

If the filler material which is poured into form structure 10 is intended to be an aggregate material of a type that does not change state (e.g. sand, pebbles, insulation), then form structure 10 (may be adapted) so that filler material can be removed from the form once it has been applied (if the filler material to be applied) For example, as shown in FIG. 6, base member 12 may include removable panels as indicated by 44 which are removed (when it is desired to remove filler material from the form structure).

When the form structure is filled with a filler material, the building is in condition to be finished. The building is finished by applying roofing material to roof rafters 40 by adding electrical or plumbing components to the building and/or by other conventional finishing steps.

While the invention has been described with reference to a number of specific embodiments, it will be understood that the spirit and scope of the present invention should be determined with reference to the appended claims.

What is claimed is:

1. A form structure comprising a plurality of walls, each wall having a pair of opposing wall members, said opposing wall members of each wall defining a wall interior therebetween, said walls of said form structure substantially defining an entire external wall structure of a complete building, said form structure being adapted for transport from a first location to a second location;

wherein each of said walls includes a top end and a bottom end, and wherein said form structure further comprises a base member receiving a bottom end of each of said walls, said base member being adapted for mounting to a foundation, said base member including removable panels allowing removal of filler material from said form structure.

2. The form structure of claim 1, wherein each of said walls include a top end and a bottom end, and wherein said form structure further comprises a base member receiving of bottom end of each of said walls, said base member being adapted for mounting to a foundation.

3. The form structure of claim 1, wherein each of said walls includes a top end and a bottom end, and where in said form structure further comprises a base member receiving of bottom end of each of said walls, said base member being adapted for mounting to a foundation, said base member having a periphery corresponding to a periphery of said entire wall structure defined by said form structure.

4. The form structure of claim 1, wherein said form structure comprises four walls.

5. The form structure of claim 1, comprising first and second pairs of opposing walls, and a plurality of rafters connecting said first pair of opposing walls.

6. A form structure comprising a plurality of modular form blocks stacked in a plurality of layers, each form block having a pair of opposing block members and at least two of said form blocks being compressed together by a compressing means, said form blocks being connected to one another to define a plurality of walls, each wall having a pair of opposing wall members, said opposing wall members of each wall defining a wall interior therebetween, said walls of said form structure substantially defining an entire external wall structure of a complete building, said modular form blocks being secured so that said form structure can be transported from a first location to a second location.

7. The form structure of claim 6, wherein said compressing means comprises means for applying a vertically directed compression force to each of said walls.

8. The form structure of claim 6, wherein each of said walls further comprises a top end and a bottom end, and wherein said compressing means comprises a tensioning member disposed in a wall interior of at least one of said walls, said tensioning member having a first end adapted to bias said bottom end upward and said top end downward so that said tensioning member applies a vertically directed compression force to at least one of said walls.

9. The form structure of claim 6, wherein each of said walls include a top end and a bottom end, wherein said form structure further comprises a top bracket attached at a top end, and a base member attached to a bottom end of at least one of said walls, and wherein said compressing means further comprises a tensioning bar having a first end adapted to bias said base member against said bottom end and a second end adapted to bias said bracket downward against said top end so that said tensioning bar applies a vertically directed compression force against at least one of said walls.

10. The form structure of claim 6, further comprising a base member on which said plurality of modular form blocks are stacked.

11. The form structure of claim 6, further comprising a base member on which said plurality of modular form blocks are stacked, wherein said base member includes removable panels adapted to be removed from said base member to allow removal of filler material from said form structure.

12. The form structure of claim 6, Wherein each of said walls includes a top end and a bottom end, and wherein said form structure further comprises a base member received at a bottom end of each of said walls, said base member being adapted for mounting to a foundation.

13. The form structure of claim 6, wherein each of said walls includes a top end and a bottom end, and wherein said form structure further comprises a base member received at a bottom end of each of said walls, said base member being adapted for mounting to a foundation, said base member having a periphery corresponding to a periphery of said entire wall structure defined by said form structure.

14. A form structure for use in making a building, said form structure comprising:

a base member; and a plurality of modular form blocks stacked in a plurality of layers on said base member wherein at least two of said form blocks are compressed together by a compressing means, each form block having a pair of opposing block members and being spaced apart by spacers, said form blocks being connected to one another to define a plurality of contiguous walls, each wall having a pair of opposing wall members and defining a wall interior therebetween, said contiguous walls of said form structure substantially defining an entire wall structure of a complete building.

15. The form structure of claim 14, wherein said compressing means comprises means for applying a vertically directed compression force to at least one of said walls.

16. The form structure of claim 14, wherein at least one of said walls further comprises a top end and a bottom end, and wherein said compressing means comprises a tensioning member disposed in a wall interior of said at least one wall, said tensioning member having a first end adapted to bias said bottom end upward and said top end downward so that said tensioning member applies a vertically directed compression force to said at least one wall.

17. The form structure of claim 14, wherein at least one of said walls comprises a top end and a bottom end, and wherein said form structure further comprises a top bracket attached at said top end, and wherein said compressing means comprises a tensioning bar having a first end adapted to bias said base member against said bottom end and a second end adapted to bias said bracket downward against said top end so that said tensioning bar applies a vertically directed compression force against said at least one wall.

18. The form structure of claim 14, wherein said form structure comprises four walls.

19. The form structure of claim 14, comprising first and second pairs of opposing walls, and a plurality of rafters connecting said first pair of opposing walls.

20. The form structure of claim 14, wherein said modular blocks include at least one corner block which defines at least two of said plurality of walls.

21. A form structure comprising:

a wall comprising a pair of opposing wall members defining an interior space therebetween, and a bottom end; and a base member received at said bottom end, said base member including removable panels which may be removed from said base member to allow removal of filler material from said form structure.

22. A form structure for use in making a building, said form structure comprising:

a base member having a hook-receiving peg extending therefrom; and a plurality of modular form blocks stacked in a plurality of layers on said base member, each form block having a pair of opposing block members and being spaced apart by spacers, said form blocks being connected to one another to define a plurality of contiguous walls, each wall having a pair of opposing wall members and defining a wall interior therebetween, said contiguous walls of said form structure substantially defining an entire wall structure of a complete building.

23. The form structure of claim 22, further including securing means for increasing a holding force between at least two of said form blocks.

24. The form structure of claim 22, further including compressing means for compressing at least two of said form blocks together.

25. The form structure of claim 22, further comprising means for applying a vertically directed compression force to at least one of said walls.

26. The form structure of claim 22, wherein at least one of said walls further comprises a top end and a bottom end, and wherein said form structure comprises a tensioning member disposed in a wall interior of said at least one wall, said tensioning member having a first end adapted to bias said bottom end upward and said top end downward so that said tensioning member applies a vertically directed compression force to said at least one wall.

27. The form structure of claim 22, wherein at least one of said walls comprises a top end and a bottom end, and wherein said form structure further comprises a top bracket attached at said top end, and wherein said form structure further comprises a tensioning bar having a first end adapted to bias said base member against said bottom end and a second end adapted to bias said bracket downward against said top end so that said tensioning bar applies a vertically directed compression force against said at least one wall.

28. The form structure of claim 22, wherein said form structure comprises four walls.

29. The form structure of claim 22, comprising first and second pairs of opposing walls, and a plurality of rafters connecting said first pair of opposing walls.

30. The form structure of claim 22, wherein said modular blocks include at least one corner block which defines at least two of said plurality of walls.

* * * * *

UNITED STATES PATENT AND TRADEMARK OFFICE

CERTIFICATE OF CORRECTION

PATENT NO. : 6,085,476
DATED : July 11, 2000
INVENTOR(S) : David B. Jantzi etal.

It is certified that error appears in the above-identified patent and that said Letters Patent is hereby corrected as shown below:

ON THE FACE OF THE PATENT

[76] Inventors: David B. Jantzi, 5480 Elm St.;
Thomas B. Roe, IV, 7693 State St.,
both of Lowville, N.Y. 13367

[73] Assignee: C.E.R. Towers, L.L.C.
RR#1, Box 120B
Lowville, NY 13367

Signed and Sealed this

Seventeenth Day of April, 2001

*Attest:*

Nicholas P. Godici

NICHOLAS P. GODICI

*Attesting Officer*

*Acting Director of the United States Patent and Trademark Office*